US008179368B2

(12) United States Patent
Yoshida et al.

(10) Patent No.: US 8,179,368 B2
(45) Date of Patent: May 15, 2012

(54) MANUAL OPERATION DEVICE

(75) Inventors: Ichiro Yoshida, Takahama (JP); Hiroshige Asada, Nagoya (JP); Yuuki Sawa, Kariya (JP)

(73) Assignee: DENSO CORPORATION, Kariya (JP)

( * ) Notice: Subject to any disclaimer, the term of this patent is extended or adjusted under 35 U.S.C. 154(b) by 1464 days.

(21) Appl. No.: 11/491,986

(22) Filed: Jul. 25, 2006

(65) Prior Publication Data

US 2007/0024120 A1 Feb. 1, 2007

(30) Foreign Application Priority Data

Jul. 27, 2005 (JP) ..... 2005-217750
Jun. 22, 2006 (JP) ..... 2006-172764

(51) Int. Cl.
*G09G 5/08* (2006.01)

(52) U.S. Cl. ..... 345/161; 345/163; 345/164; 345/156; 345/184

(58) Field of Classification Search ..... 345/161, 345/156, 184
See application file for complete search history.

(56) References Cited

U.S. PATENT DOCUMENTS 6,169,540 B1 * 1/2001 Rosenberg et al. ..... 715/701
6,593,667 B1 7/2003 Onodera et al.
6,636,197 B1 * 10/2003 Goldenberg et al. ..... 345/156
6,885,925 B2 4/2005 Sanpei et al.
7,434,458 B2 * 10/2008 Nishizawa et al. ..... 73/161
2002/0057064 A1 * 5/2002 Onodera ..... 318/2

FOREIGN PATENT DOCUMENTS

JP A-2004-17761 1/2004
JP A-2004-247953 9/2004

OTHER PUBLICATIONS

An Office Action dated May 23, 2008, in a corresponding German Patent Application No. 10 2006 033 682.8-53 (and English Translation).
Office Action dated Oct. 10, 2007 in corresponding German Patent Application No. 10 2006 033 682.8 (and English translation).
Office Action dated Jul. 24, 2009 in a corresponding Chinese Patent Application No. 2006101080615 (and English translation).

* cited by examiner

*Primary Examiner* — Richard Hjerpe
*Assistant Examiner* — Leonid Shapiro
(74) *Attorney, Agent, or Firm* — Posz Law Group, PLC

(57) ABSTRACT

A manual operation device of the present disclosure allows a user to intuitively recognize a force pattern by providing a graphical representation of the force pattern on a display unit. The force pattern or a relationship between an operation position an operation unit of the manual operation device and a control value is visually represented as, for example, a two-dimensional line graph. In this manner, the reaction force is suitably adjusted to an operation force of the user to reduce an false operation of the manual operation device, because the user can easily controls the reaction force for achieving an improved operability.

9 Claims, 12 Drawing Sheets

FIG. 7

| | X0 | X1 | X2 | X3 | X4 | X5 | X6 | X7 |
|---|---|---|---|---|---|---|---|---|
| Y7 | +1<br>−1<br>* | +1<br>0<br>* | +1<br>0<br>* | 0<br>0<br>A−8 | 0<br>0<br>A−8 | −1<br>0<br>* | −1<br>0<br>* | −1<br>−1<br>* |
| Y6 | 0<br>−1<br>* | +1<br>−1<br>* | +1<br>0<br>* | 0<br>0<br>A−8 | 0<br>0<br>A−8 | −1<br>0<br>* | −1<br>−1<br>* | 0<br>−1<br>* |
| Y5 | 0<br>−1<br>* | 0<br>−1<br>* | +1<br>−1<br>* | 0<br>0<br>* | 0<br>0<br>* | −1<br>−1<br>* | 0<br>−1<br>* | 0<br>−1<br>* |
| Y4 | 0<br>0<br>B−3 | 0<br>0<br>B−3 | 0<br>0<br>* | 0<br>0<br>* | 0<br>0<br>* | 0<br>0<br>* | 0<br>0<br>B−5 | 0<br>0<br>B−5 |
| Y3 | 0<br>0<br>B−3 | 0<br>0<br>B−3 | 0<br>0<br>* | 0<br>0<br>* | 0<br>0<br>* | 0<br>0<br>* | 0<br>0<br>B−5 | 0<br>0<br>B−5 |
| Y2 | 0<br>+1<br>* | 0<br>+1<br>* | +1<br>−1<br>* | 0<br>0<br>* | 0<br>0<br>* | −1<br>+1<br>* | 0<br>+1<br>* | 0<br>+1<br>* |
| Y1 | 0<br>+1<br>* | +1<br>+1<br>* | +1<br>0<br>* | 0<br>0<br>A−4 | 0<br>0<br>A−4 | −1<br>0<br>* | −1<br>+1<br>* | 0<br>+1<br>* |
| Y0 | +1<br>+1<br>* | +1<br>0<br>* | +1<br>0<br>* | 0<br>0<br>A−4 | 0<br>0<br>A−4 | −1<br>0<br>* | −1<br>0<br>* | −1<br>+1<br>* |

Y: + ↑ −

X: − → +

MANUAL OPERATION DEVICE

CROSS REFERENCE TO RELATED APPLICATION

This application is based on and claims the benefit of priority of Japanese Patent Applications No. 2005-217750 filed on Jul. 27, 2005, and No. 2006-172764 filed on Jun. 22, 2006, the disclosure of which is incorporated herein by reference.

FIELD OF THE INVENTION

The present invention generally relates to a manual operation device in a vehicle.

BACKGROUND OF THE INVENTION

In recent years, various vehicular systems and devices such as an air-conditioner, a radio, a CD/DVD player, a navigation system and the like are controlled by using a manual operation device, that is, a manual operation control unit having, for example, a rotary switch or the like. More practically, control information for setting temperature, for a selection of radio stations, for organizing a navigation route or the like is integrally displayed on a display unit, and a user, i.e., an occupant or a driver of the vehicle, is encouraged to control operation conditions of those systems and devices by, for example, a button in a touch panel on the display unit or the like.

However, the occupant of the vehicle is required to watch the operation conditions represented on the display unit very carefully in order to see the result of his/her control while being involved in, for example, a driving operation of the vehicle. In other words, arbitrary arrangement of the buttons and/or an indicator on the display unit may not be very easy to read in terms of readiness for control result recognition unless the occupant are familiar with the arrangement of the buttons and/or representation of the control result.

In view of the above-described problems, disclosure in Japanese Patent Document JP-A-2001-84475 describes a technique of "Haptics," or a reaction force control technique in response to an operation of a control device and/or a situation of a control operation. This technique controls a manual operation of a control interface of various devices by providing a reaction force to the interface according to an operation position, an operation condition of the device. The disclosure of the above document also describes an application of a thrusting force in addition to the reaction force.

More practically, the application of the reaction force works in the following manner. That is, the haptics technique applies resistance to a volume-up control operation of, for example, a CD/DVD player by providing the reaction force when the user operates a manual operation volume switch on the player, and a volume-down control operation of the manual operation volume switch is assisted by a provision of the thrusting force to facilitate rotation of the volume switch in a volume-down direction. In this manner, a sudden burst of large sound is prevented when the occupant controls the volume switch toward a greater volume, or a sharp decrease of large sound is possible for providing a conversational sound condition in the vehicle based on the thrusting force for the volume down control.

However, the reaction force and/or the thrusting force may not always provide an appropriate assist for the occupant or the driver to suitably operate the volume switch or the like. For example, the reaction force having a less-than-expected resisting force strength may allow the user to drive a manual operation control unit excessively to select an intended function. Further, the reaction force may induce or trigger an unintended invocation of assigned function when the occupant unconsciously operates the manual operation control unit besides being involved in the driving operation. On the other hand, the reaction force may restrict the manual operation of the occupant who is too weak to resist the reaction force applied thereto. The reaction force having a more-than-expected strength may distract the attention of the occupant away from, for example, the driving operation of the vehicle.

Based on the reasoning described above, the manual operation control unit may preferably apply the reaction force to the manual operation of the occupant or the like in an adjustable manner. Disclosure in Japanese Patent Document JP-A-2003-260949 describes the adjustment method of the reaction force for the Haptics devices. This technique defines plural characteristic points and connecting function for forming a force pattern applied to the manual operation control unit in order to reduce the number of settings for force pattern definition. In this manner, the manual operation control unit which usually requires a detailed reaction force definition for every operation position in an entire control area can be suitably operated by the manual operation of the user by defining only a few control values for characteristic points.

However, the control values for the characteristic points can only be discovered based on a sufficient knowledge of the characteristic points and the connecting function accompanied by a knack of settings. Further, the connecting function may deceive an intuition of the user of the manual operation control unit in terms of the strength of the reaction force between the characteristic points, thereby causing difficulty for reaction force adjustment by the user.

SUMMARY OF THE INVENTION

In view of the above-described and other problems, the present disclosure provides a manual operation device that has an easily adjustable reaction force in response to an operation by a user.

The manual operation device in connection to a display unit includes an operation unit for generating an operation signal when movement of the operation unit is caused by a manual operation, an actuator for applying a driving force to the operation unit, a position detector for detecting an operation position of the operation unit, a storage unit for storing a force pattern that simultaneously defines a first relationship between the position of the operation unit and a regulation control value for regulating the driving force of the actuator and a second relationship between the position of the operation unit and a control signal to control an external device, and a control unit for simultaneously outputting the regulation control value to the actuator and the control signal to the external device based on the force pattern stored in the storage unit and the position of the operation unit detected by the position detector. The control unit in the manual operation device outputs visual representation information for representing on the display unit the first relationship between the position of the operation unit and the regulation control value in the force pattern stored in the storage unit, and the control unit modifies the first relationship between the position of the operation unit and the regulation control value in the force pattern stored in the storage unit based on one of modification information from an external source and modification information by an operation of the operation unit. In this case, the external source indicates, for example, an operation key pad coupled with the manual operation device.

The manual operation device of the present disclosure allows the user to intuitively recognize the force pattern by providing a graphical representation of the force pattern on the display unit. In other words, the force pattern or a relationship between an operation position of the operation unit and a control value is visually represented as, for example, a two-dimensional line graph. The user inputs modification information of the force pattern based on the graphical representation for making an adjustment of the reaction force generated by the actuator that drives the operation unit or the like of the manual operation device in response to the operation of the user. In this manner, the reaction force is suitably adjusted to an operation force of the user to reduce an false operation of the manual operation device caused by the reaction force that is too weak or too strong relative to the operation force of the user. Further, the user can easily controls the reaction force for achieving an improved operability.

In another aspect of the present disclosure, the force pattern can be controlled by the operation of the operation unit or by the modification information from an external source based on the visual representation of the force pattern on the display unit. In this manner, the operation position of the operation unit for outputting the control signal for the external device can be easily adjusted according to the user preference because of the assistance of the visual representation.

The visual representation of the force pattern includes a two-dimensional line graph and a three-dimensional surface graph. The reaction force applied to the operation unit may be represented as a height of the line graph along the y axis of the graph, and the operation position of the operation unit, i.e., a direct distance from a home position, may be represented as a reading of the x axis of the graph. In this manner, the reaction force around the home position may be symmetrically defined by using the line graph, thereby allowing the user for easily making an adjustment through a graphical interface.

Further, the line graph may be substituted by the surface graph, and the height of the surface from a standard plane, e.g., the x-y plane, may represent a simulated potential energy of a surface point measured along, for example, the z axis. In this manner, the reaction force at a specific operation position of the operation unit may be defined as a simulation of an acceleration of a particle in proportion to the potential energy lost or acquired in the course of the movement along the surface of the graph, thereby allowing the user for easily making an adjustment through a graphical interface.

Furthermore, the reaction force may be controlled based on the measurement of the operation force applied by the user to the operation unit. In this manner, the reaction force may suitably assist the operation of the operation unit by the user. In addition, the adjustment of the reaction force may be made based on an averaged value of the measurement, thereby enabling reduction of a trouble of calculation or the like on the user side.

Furthermore, the reaction force may be controlled based on the measurement of operation time from the home position to a periphery of an position area of the operation unit. In this manner, the reaction force of the operation unit can be suitably adjusted to the user's preference, thereby enabling a reduction of the false operation.

BRIEF DESCRIPTION OF THE DRAWINGS

Other objects, features and advantages of the present invention will become more apparent from the following detailed description made with reference to the accompanying drawings, in which:

FIG. 7 shows a table of force patterns for controlling the operation unit;

DETAILED DESCRIPTION OF THE PREFERRED EMBODIMENTS

Embodiments of the present disclosure are described with reference to the drawings. The embodiments of the present disclosure are not necessarily limited to the types/forms in the present embodiment, but may take any form of the art or technique that is regarded within the scope of the present disclosure by artisans who have ordinary skill in the art.

Figure 1:
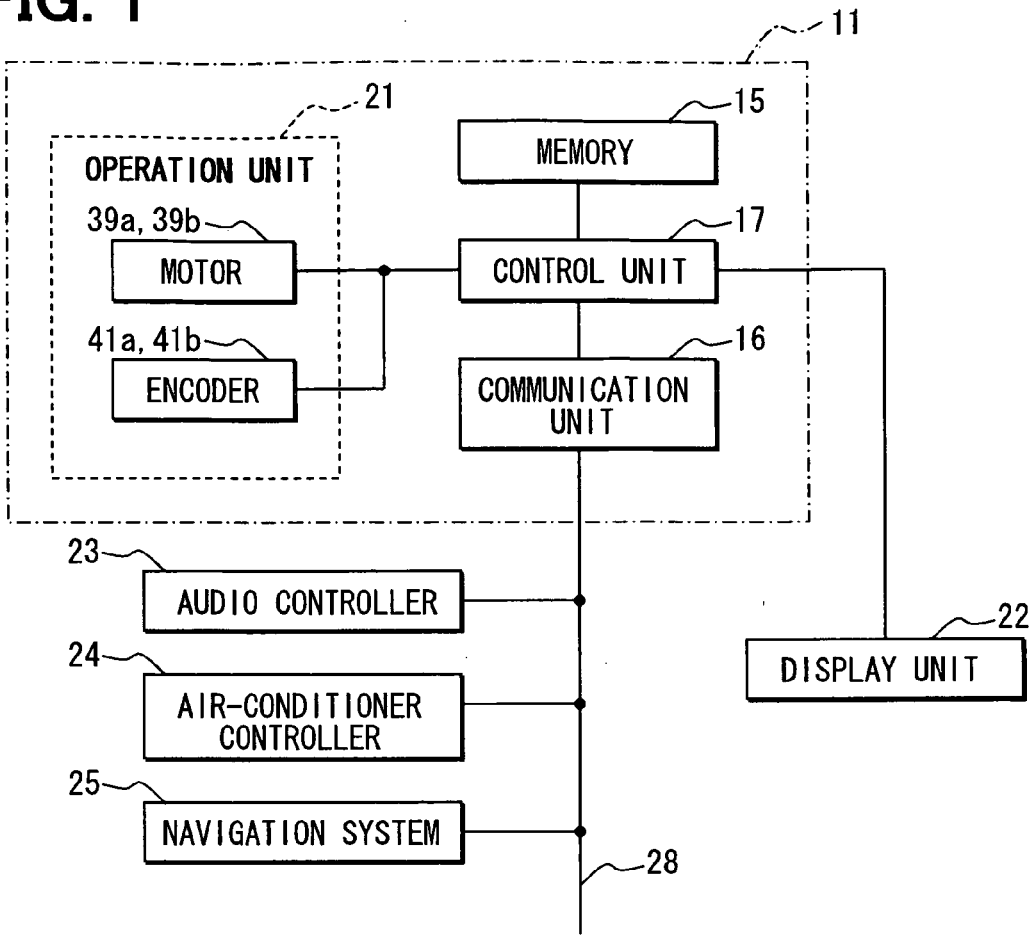
FIG. 1 shows a block diagram of a manual operation device in an embodiment of the present disclosure.

FIG. 1 shows a block diagram of a manual operation device 11 and relevant devices attached thereto. The manual operation device 11 includes an operation unit 21, a memory 15, a communication unit 16, and a control unit 17. The communication unit 16 is coupled with an audio controller 23, an air-conditioner controller 24, and a navigation system 25 through a vehicle LAN 28. The control unit 17 is also coupled with a display unit 22. The manual operation device 11 is disposed close to a driver's seat in a vehicle, and is operable by a driver of the vehicle who sits in the driver's seat.

The operation unit 21 is a unit that is operated by the driver of the vehicle, or a user of the manual operation device 11. The operation unit 21 has electric motors 39*a*, 39*b* and encoders 41*a*, 41*b*.

The electric motors 39*a*, 39*b* provides a force to an operation handle 31 described later based on a control value inputted from the control unit 17.

The encoders 41*a*, 41*b* are sensors for detecting an operation position (an operation condition) of the operation handle 31 to output a detection result to the control unit 17.

The memory 15 stores operation data such as a force pattern or the like. The force pattern is a collective set of values that represents a relationship between the operation condition of the operation handle 31 and a control signal to be outputted for controlling vehicular devices such as an audio system, an air-conditioner, a navigation system or the like. The force pattern is associated with an ID for identifying the driver of the vehicle such as a user ID for serving individual drivers. Each of the force patterns includes a pair of force patterns, that is, a stop-time force pattern and a drive-time force pattern. Further, a force pattern may be specifically prepared for a specific vehicular device depending on the type of the devices.

The communication unit 16 exchange information with various device in the vehicle through the vehicle LAN 28.

The control unit 17 includes a CPU, a ROM, a RAM and the like for executing various operations based on a program stored in the ROM. The control unit 17 outputs the control value to the electric motors 39*a*, 39*b* according to the force pattern retrieved in the RAM.

The vehicle LAN 28 is a local area network extended in the vehicle, and is used for information exchange between the vehicular devices such as the audio controller 23, the air-conditioner controller 24, the navigation system 25 and the like.

The audio controller 23 controls an audio system not shown in the drawings, and the air-conditioner controller 24 controls an air-conditioner not shown in the drawings.

The navigation system 25 includes a display unit, a map data disk, a GPS receiver and the like for displaying a current position of the vehicle and providing route navigation or the like.

The display unit 22 is a liquid crystal display, an organic EL display or the like for displaying an image of map data or the like.

Figure 5:
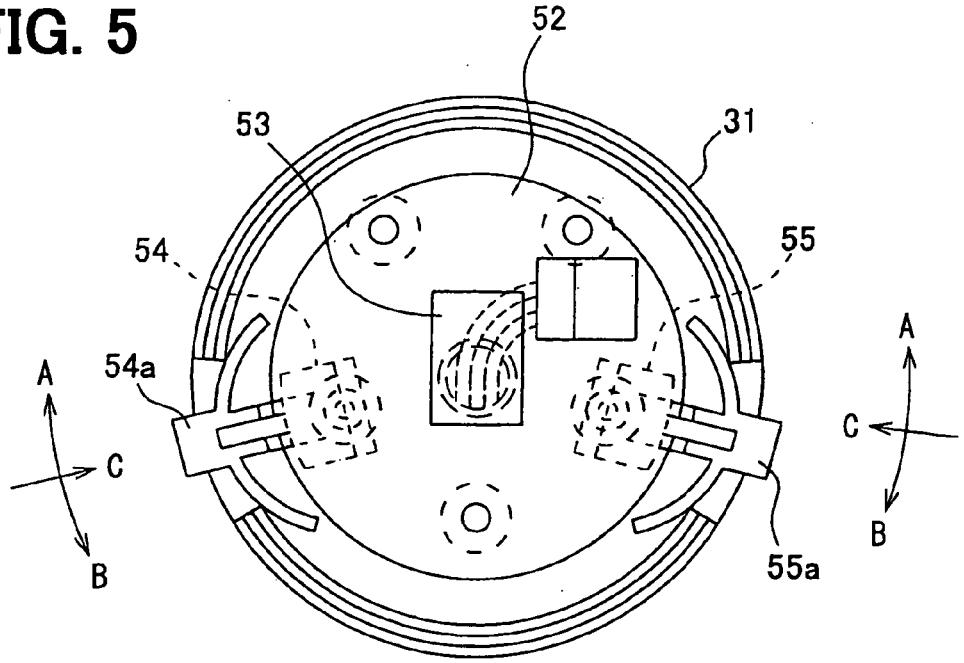
FIG. 5 shows a top view of the operation unit with an operation handle removed therefrom.
Figure 2:
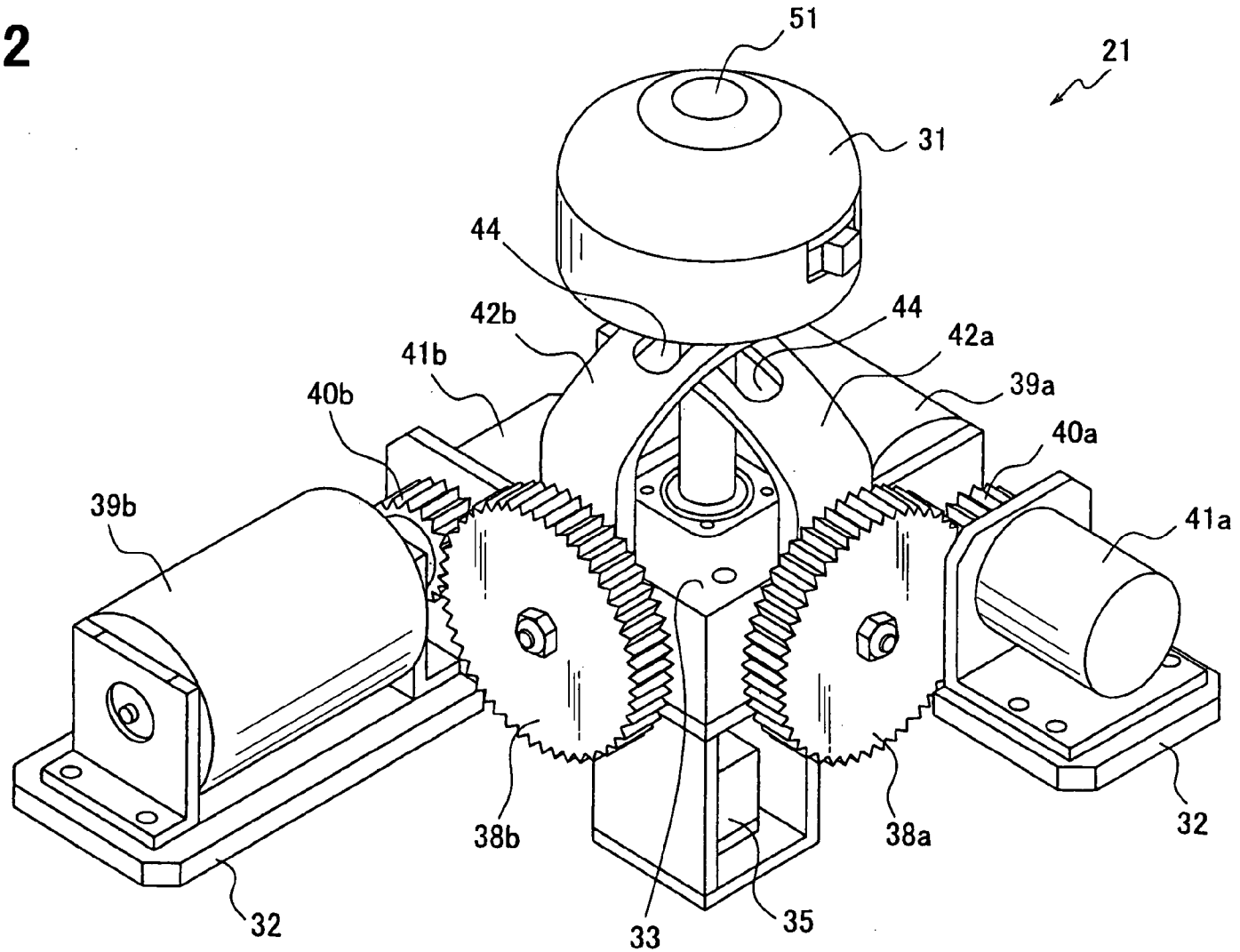
FIG. 2 shows a perspective view of an operation unit of the manual operation device.
Figure 3:
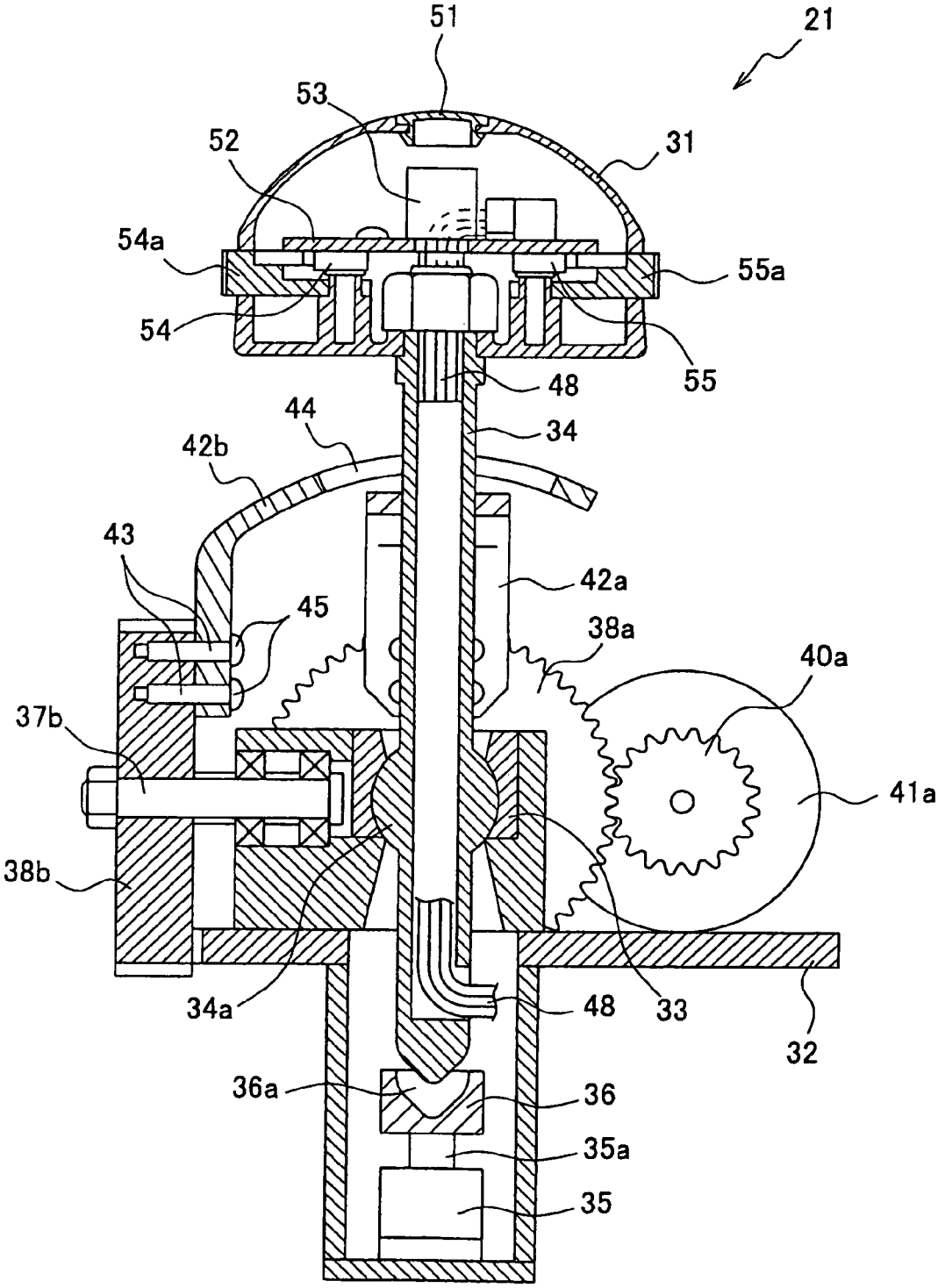
FIG. 3 shows a cross-sectional side view of the operation unit.
Figure 4:
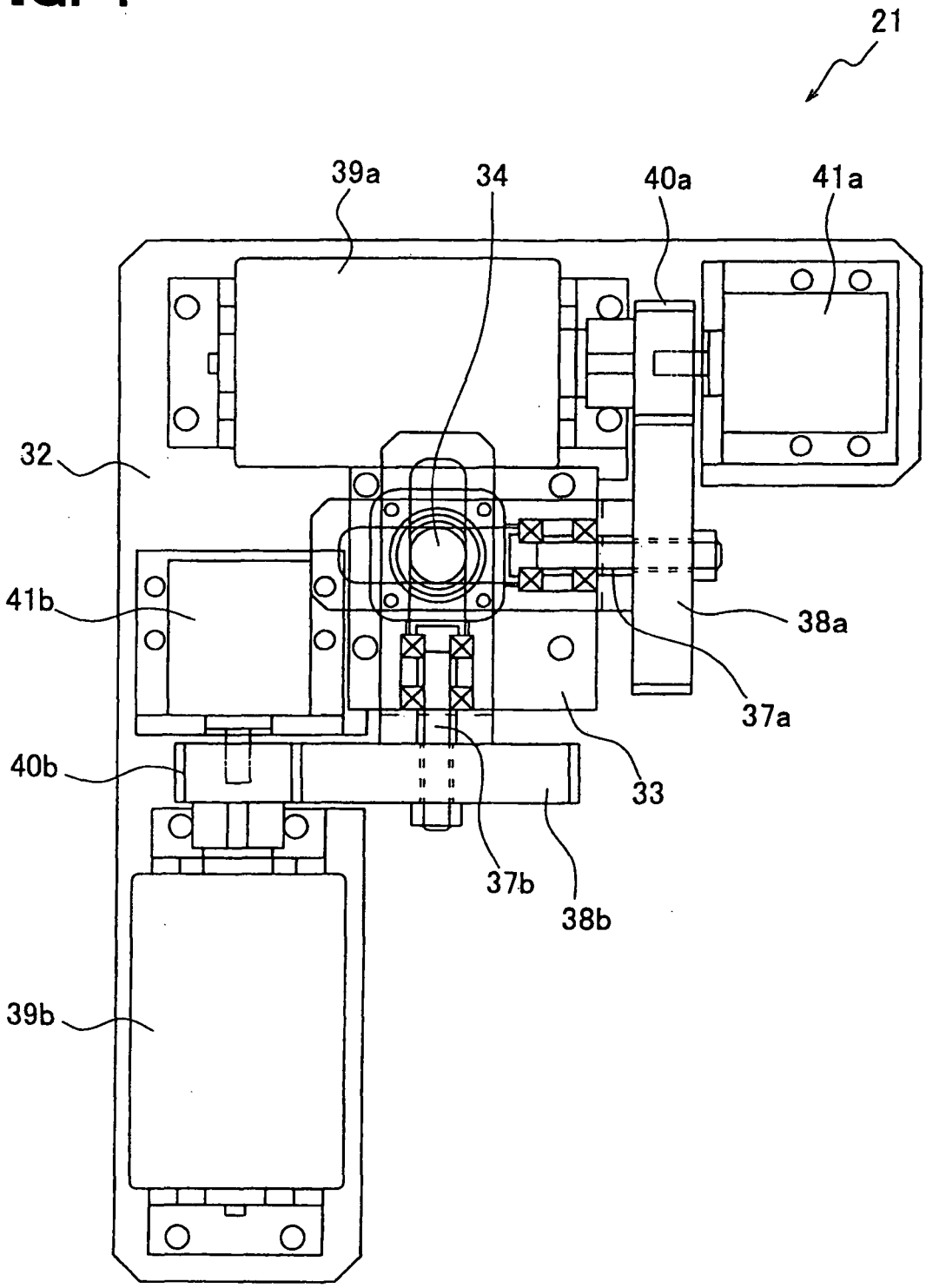
FIG. 4 shows a cross-sectional plan view of the operation unit.

A structure of the operation unit 21 is described with reference to the drawings. FIG. 2 shows a perspective view of the operation unit 21, FIG. 3 shows a cross-sectional side view of the operation unit 21, FIG. 4 shows a cross-sectional plan view of the operation unit 21, and FIG. 5 shows a top view of the operation unit 21 with the operation handle 31 removed from the structure.

As shown in FIGS. 2 to 5, the operation unit 21 includes a base 32 that can be fixed onto a body of the vehicle, a spherical bearing 33 disposed on the base 32, an operation shaft 34 that has a spherical portion 34*a* disposed at a lower side of a middle part of the axis body being held in a pivotally movable manner in the spherical bearing 33, a solenoid 35 disposed at a lower side of the spherical bearing 33, a cramp member 36 at a top of a drive shaft 35*a* of the solenoid 35 for cramping the operation shaft 34, rotation axes 37*a*, 37*b* perpendicularly crossing in a plane that is parallel to the base 32 with the crossing center point coinciding with the center of the spherical bearing 33, large gear wheels 38*a*, 38*b* fixed on each of the rotation axes 37*a*, 37*b*, the electric motors 39*a*, 39*b* disposed in parallel with rotation axes 37*a*, 37*b*, small gear wheels 40*a*, 40*b* respectively fixed on main shafts of the electric motors 39*a*, 39*b* and engaged with the large gear wheels 38*a*, 38*b*, the encoders 41*a*, 41*b* for detecting the rotation direction and rotation amount of the main shafts of the electric motors 39*a*, 39*b* and L shape members 42*a*, 42*b* for transferring the pivotal movement of the operation shaft 34 to the rotation axes 37*a*, 37*b* after converting the pivotal movement to a rotational movement. The operation shaft 34 has an operation handle 31 disposed on a top.

An lower end of the operation shaft 34 has a conical shape shrinking toward the lower end, and the cramp member 36 opposed to the lower end of the operation shaft 34 has a concave portion 36*a* for catching the lower end of the operation shaft 34. Therefore, the cramp member 36 raised upward by an ON-operation of the solenoid 35 cramps the lower end of the operation shaft 34 by the concave portion 36*a*, thereby prohibiting the pivotal movement of the operation shaft 34 around the spherical portion 34*a*. The cramp member 36 lowered by an OFF-operation of the solenoid 35 allows the pivotal movement of the operation shaft 34 by releasing an engagement of the cramp member 36 to the operation shaft 34.

The L shape members 42*a*, 42*b* have a screw hole 43 on one end and an operation shaft hole 44 on the other end. The L shape members 42*a*, 42*b* is fixed on a side face of the large gear wheels 38*a*, 38*b* with a screw 45 that is inserted in the screw hole 43. The operation shaft hole 44 on each of the L shape members 42*a*, 42*b* is engaged with the operation shaft 34 as shown in FIG. 3. The width of the operation shaft hole 44 is closely adjusted to a size of the diameter of the operation shaft 34 in order for reducing a backlash of the operation shaft 34 as long as the movement of the operation shaft 34 is not restricted. Further, the length of the operation shaft hole 44 is set to be equal to or greater than a movable range of the operation shaft 34. In this manner, the pivotal movement of the operation handle 31 drives the operation shaft 34 in X and Y directions, thereby providing rotational movement to the encoders 41*a*, 41*b* based on the rotational movement of the large gear wheels 38*a*, 38*b* and the small gear wheels 40*a*, 40*b* caused by the L shape members 42*a*, 42*b* being engaged therewith. As a result, the operation condition of the operation shaft 34 is detected by the control unit 17.

The operation handle 31 is, as shown in FIGS. 2 and 3, in a dome shape having a transparent window 51 at a center of a top portion. Inside the transparent window 51, the operation handle 31 houses a substrate 52 and a photo-interrupter 53 that includes a light emitter and a light receptor disposed on a portion of the substrate 52 that opposes the window 51 as shown in FIGS. 3 and 5. The substrate 52 bears a first and a second switches 54, 55 on its periphery.

The photo-interrupter 53 controls ON/OFF operation of the solenoid 35. More practically, the light emitter (not shown) emits a light having a specific wavelength, e.g., an infra red light, and the light receptor receives the light of the specific wavelength for ON operation of the solenoid 35 for allowing the pivotal movement of the operation shaft 34 by lowering the cramp member 36 to disengage the cramp member 36 and the operation shaft 34. The photo-interrupter 53 has a supply of power source and an exchange of control signal through a cord 58 disposed in the operation shaft 34.

The first and second switches 54, 55 respectively have a function of a rotational movement detection switch and a depression movement detection switch. The non-operation condition of the switches 54, 55 leaves a knob of the switches at a center position of switching operation. A first knob 54*a* and a second knob 55*a* on the switches 54, 55 are, as shown in FIG. 5, symmetrically disposed on an outer periphery of the operation handle 31 for receiving user operation in A, B or C direction from the center position. The operation in A and C directions is a rotational operation, and the operation in B direction is a depression operation. The operation of the knobs 54*a*, 55*a* in the first and second switches is assigned to execute an arbitrary function of the associated device.

The electric motors 39*a*, 39*b* provides a resistive force to the operation handle 31 by, for example, regulating the operation direction, operation speed, and/or operation position of the operation handle 31 based on the amount of the operational movement of the handle 31. More practically, the operational movement of the operation handle 31 in a predetermined direction is facilitated by providing the resistive force against the operational movement toward a direction other than the predetermined direction with the electric motors 39*a*, 39*b* so that the operational movement of the operation handle 31 can be used to precisely control a use of a vehicular device or can be used to precisely control a functional control of a selected vehicular device. In this manner, the user can recognize a physical feedback to a sensory organ and control the operation handle 31 in a suitable direction, thereby preventing an undesirable operation of the operation handle 31.

The operation handle 31 may cause wear of, for example, the spherical bearing and the operation shaft 34 at the abutment portion when an edge of the spherical bearing is abutted to the operation shaft 34. The abutment of these parts may lead to generate abrasion powders to be bitten between the gaps of these parts, and may disable a smooth movement of the parts. Therefore, the operational movement of the operation handle 31 may be restricted by providing a torque impacted against the user operation at a predetermined operation position with the electric motors 39*a*, 39*b*. In this manner, the user, e.g., the driver of the vehicle, can recognize the that the operation handle 31 reaches a limit of an operation range based on a feedback to the sensory organ. As a result, an excessive operation of the operation handle 31 is prevented with an accompanying merit of decreased generation of the abrasion powders. In addition, the operation handle 31 may be returned to the center position with an assistance of the torque generated by the electric motors 39*a*, 39*b*.

Figure 6:
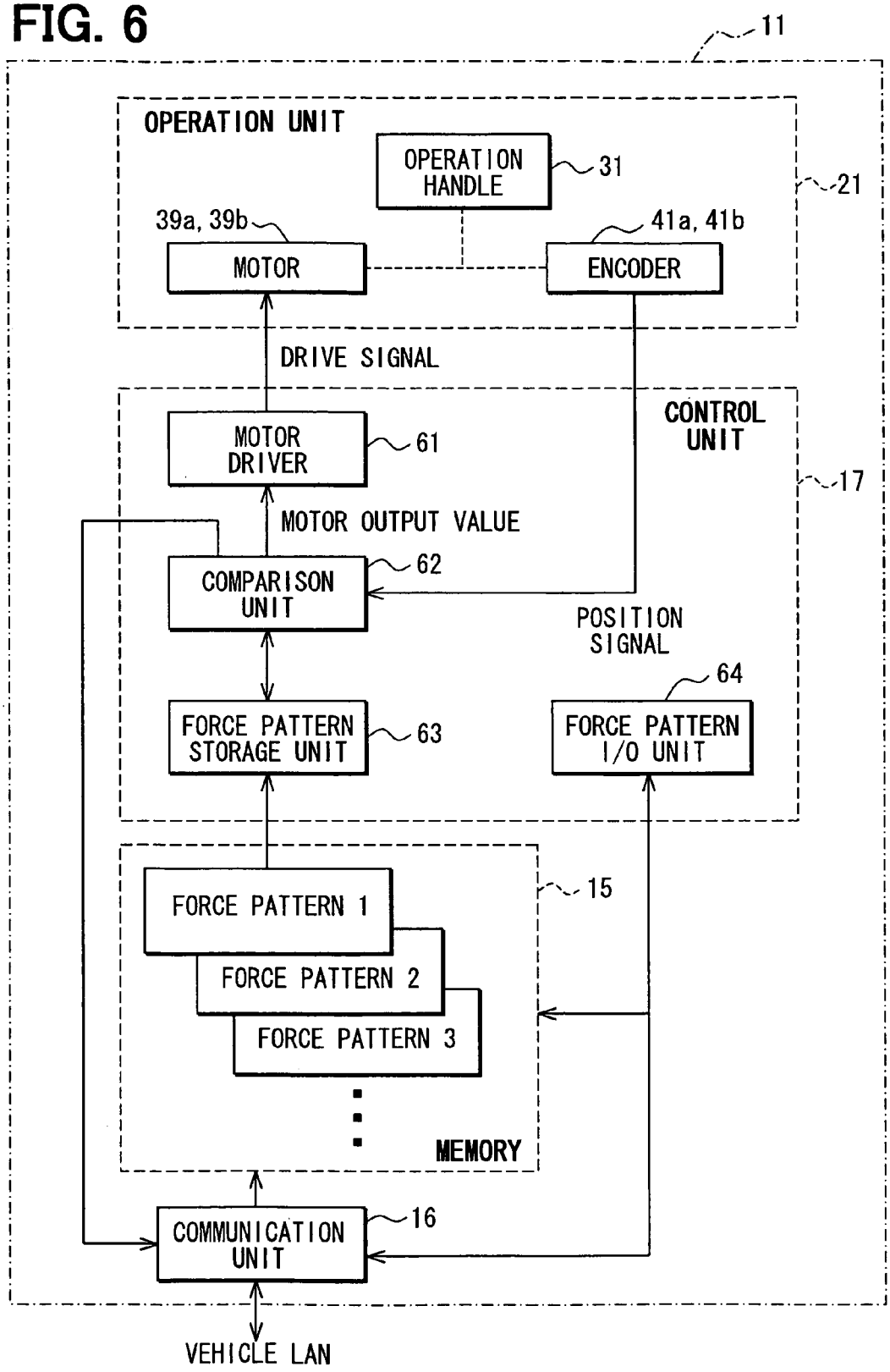
FIG. 6 shows a detailed block diagram of a control unit and other components in the manual operation device.

The control unit 17 and the memory 15 in the manual operation device 11 is described with other drawings. FIG. 6 shows a detailed block diagram of the control unit 17 and other components. The control unit 17 includes a motor driver 61, a comparison unit 62, a force pattern storage unit 63, and a force pattern I/O unit. The units and components in the control unit 17 is implemented by using the CPU, the ROM, the RAM, an I/O and the like not presented in the figure.

The motor driver 61 outputs a drive signal for driving the electric motors 39*a*, 39*b* based on a comparison result (a motor output value) from the comparison unit 62.

The comparison unit 62 compares the force pattern stored in the force pattern storage unit 63 with a position signal from the encoders 41*a*, 41*b* to determine the comparison result (the motor output value) to be outputted to the motor driver 61. The force pattern storage unit 63 retains a single set of the force pattern retrieved from the memory 15. The force pattern retained in the storage unit 63 can be referenced by the comparison unit 62. The force pattern I/O unit 64 transmits the force pattern to an external unit through the communication unit 16, and stores the force pattern received by the communication unit 16 in the memory 15.

The memory 15 stores a plurality of force patterns to be used for controlling the operation handle 31. FIG. 7 shows a table of the force pattern taken as an example. The table in FIG. 7 lists ON/OFF operation of the electric motors 39*a*, 39*b* accompanied by the direction of rotation. In the table, the operation of the operation handle 31 is divided into eight equivalent steps in X and Y directions respectively. The top row of each cell is the ON/OFF operation of the first motor 39*a* and the middle row is the ON/OFF operation of the second motor 39*b* respectively accompanied by the rotation direction of a normal rotation (+) or a reverse rotation (−). A figure "0" in the top/middle row designates an ON operation of the electric motors 39*a*, 39*b* (the motors are rotated), a figure "1" designates an OFF operation of the electric motors 39*a*, 39*b* (the motors are not rotated). The bottom row in the cell represents a symbol ("A," "B," etc.) of object devices to be controlled and control signal values ("8," "3," etc.). In this case, the value of "*" designates that no specific device is specified as an object of control.

According to the table in FIG. 7, the cells of (X3, Y0) to (X3, Y7), (X4, Y0) to (X4, Y7), (X0, Y3) to (X7, Y3) and (X0, Y4) to (X7, Y4) specifies that the operation handle 31 operated to the position of those cells does not receive the resistive force from the electric motors 39*a*, 39*b*. The operation handle 31 positioned in other cells receives the resistive force from at least one of the electric motors 39*a*, 39*b*. Further, for example, the operation handle 31 positioned in the cells (X3, Y0) to (X3, Y1) and (X4, Y0) to (X4, Y1) outputs the control signal value of "4" to the object device of "A" through the communication unit 16. The control signal value of "0" indicates that the operation of the operation handle 31 does not output the control signal to the device, and stores the force pattern of the object device retrieved from the memory 15 to the force pattern storage unit 63. The force pattern may include type information, user information that associates the force pattern with a specific user, device information that associates the force pattern with a specific device and similar information.

The operation of the manual operation device 11 is described with reference to flowcharts and illustrations in the following.

Figure 8:
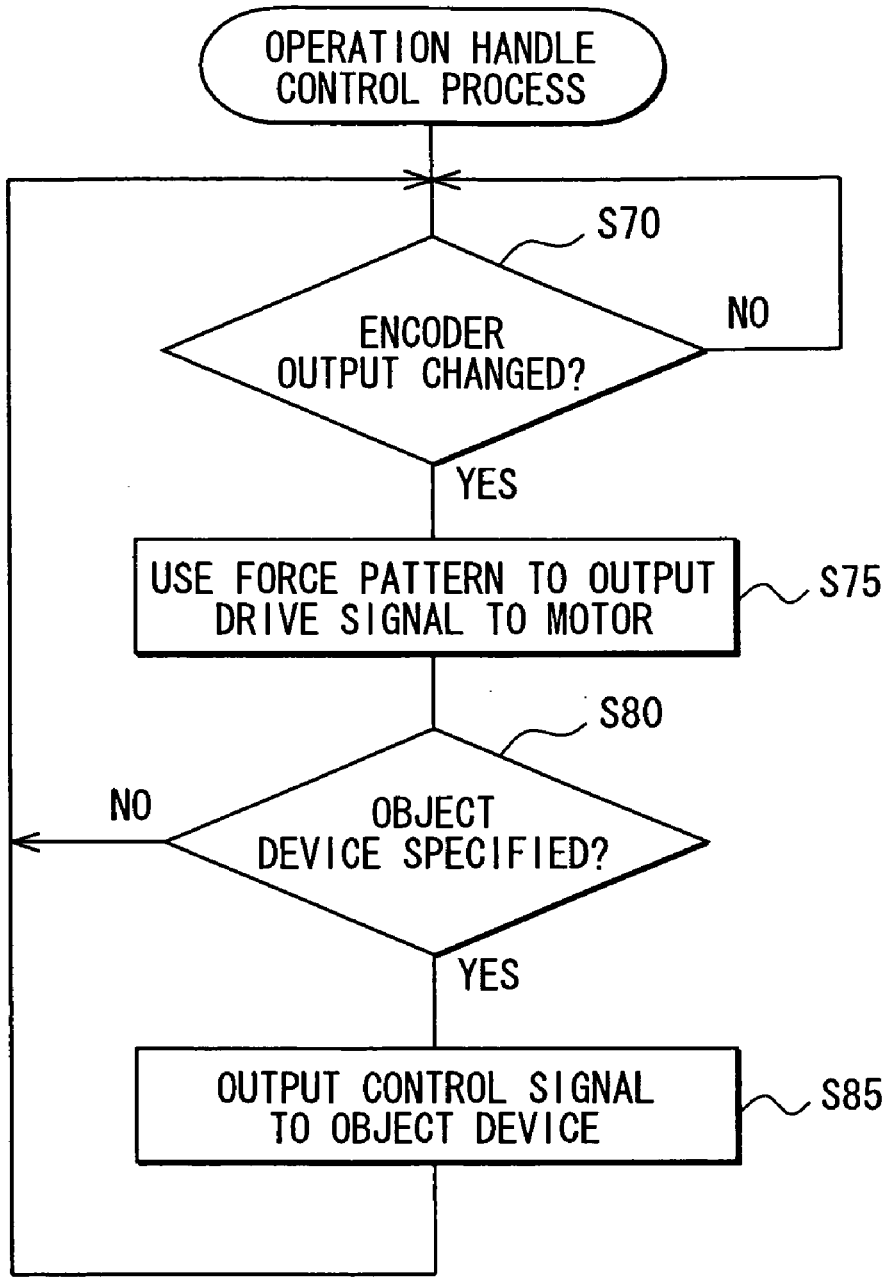
FIG. 8 shows a flowchart of an operation handle control process in the control unit.

FIG. 8 shows a flowchart of an operation handle control process in the control unit 17. The operation handle control process is executed after an initialization process described later in the present embodiment. The operation handle control process is mainly controlled by the comparison unit 62 in the control unit 17.

The comparison unit 62 determines whether a change is detected in an output from the encoders 41*a*, 41*b* in step S70. The process proceeds step S75 when the change is detected in the output (step S70:YES). The process repeats step S70 when the change is not detected in the output (step S70:NO).

The comparison unit 62 refers to the force pattern stored in the force pattern storage unit 63 in step S75, and determines the output value to the electric motors 39*a*, 39*b* based on the position signal from the encoders 41*a*, 41*b*. The motor driver 61 drives the electric motors 39*a*, 39*b* based on the output value determined by the comparison unit 62.

The comparison unit 62 determines whether a symbol of an object device is specified in the cell of the force pattern based on the position signal from the encoders 41*a*, 41*b* in step S80. For example, the comparison unit 62 that the bottom row in the cell has an object device data such as "A-8" or the like as shown in FIG. 7. The process proceeds step S85 when the object device is specified in the cell (step S80:YES), and the process proceeds step S70 when the object device is not specified in the cell (step S80:NO).

The process in the comparison unit transfers the control signal value to the object device specified by the symbol through the communication unit 16 in step S85. After transmitting the control signal value, the process returns to step S70. The operation handle control process described above may be executed within 10 milliseconds in the control unit 17.

The initialization process executed by the control unit 17 is described with reference to a flowchart in FIG. 9. The initialization process starts when the driver in the driver's seat is detected by a seat sensor (not shown in the figure).

The control unit 17 determines the driver of the vehicle after starting the initialization process. That is, who the driver is determined by the control unit 17 in step S105. For example, a camera captures an image inside of the vehicle, and image recognition technique is used to determined the driver. The driver may be determined based on an input of a user ID or the like.

In step S110, the initialization process determines whether the force pattern for the identified driver is stored in the memory 15. The process proceeds step S115 when the force pattern for the identified driver is found in the memory 15 (step S110:YES). The process proceeds step S125 when the force pattern for the identified driver is not found in the memory 15.

In step S115, the initialization process retrieves the force pattern from the memory 15 to the force pattern storage unit 63 in the control unit 17 and developed in the storage unit 63 for further processing. Then, in step S120, the initialization process queries the driver about modification of the force pattern. For example, a message "Modifying force pattern? Move operation handle forward to modify the force pattern, or backward not to modify." is displayed on the display unit 22. The user operates the operation handle 31 in response to the above message, and the user's intention is inputted to the control unit 17. The massage on the display unit 22 may be substituted by a guidance voice from a speaker.

The process proceeds step S125 when the modification of the force pattern is requested by the user (step S120:YES). The process proceeds to step S150 when the modification is not requested by the user (step S120:NO).

In step S125, the process executes an operation force measurement process described later in the present embodiment. The operation force measurement process measures the operation force of the driver for determining an optimum operational reaction force and a restrictive reaction force. After determining the measurement process, The process proceeds step S130 for force pattern setting in a force pattern setting mode.

The force pattern setting mode is described in detail. In the force pattern setting mode, the control unit 17 displays a setting screen 301 in FIG. 10 on the display unit 22 based on the force pattern stored and developed in the force pattern setting unit 63. The control unit 17 displays a default force pattern in the ROM of the control unit 17 when the force pattern is not found in the force pattern storage unit 63. The force pattern described in the following is the stop-time force pattern.

The screen 301 represents an operation area of the operation handle 31 as an operation plane 303, icons 305 to be positioned in the operation plane 303, a plan view button 307 for switching the screen to a plan view, a section view button 309 for switching the screen to a cross-sectional view, a store button 311 for storing the force pattern in the force pattern storage unit 63 in the memory 15, a test button 313 for controlling the operation handle 31 by using the force pattern currently held in the force pattern storage unit 63, and an end button 319 for ending the force pattern setting mode.

The operation plane 303 represents a top view of the operation area of the operation handle 31. Four holes 316*a* to 316*d* are located in four positions of front/back and right/left (relative to a looking direction of the driver) in FIG. 10. The four holes 316*a* to 316*d* are the icons for representing an operational reaction force decreased area. In the operational reaction force decreased area, the operational reaction force is decreased relative to surrounding areas. Therefore, movement of the operation handle 31 is facilitated toward the holes 316*a* to 316*d*. The movement of the operation handle 31 toward the holes 316*a* to 316*d* may be further facilitated by using a thrusting force.

Figure 10:
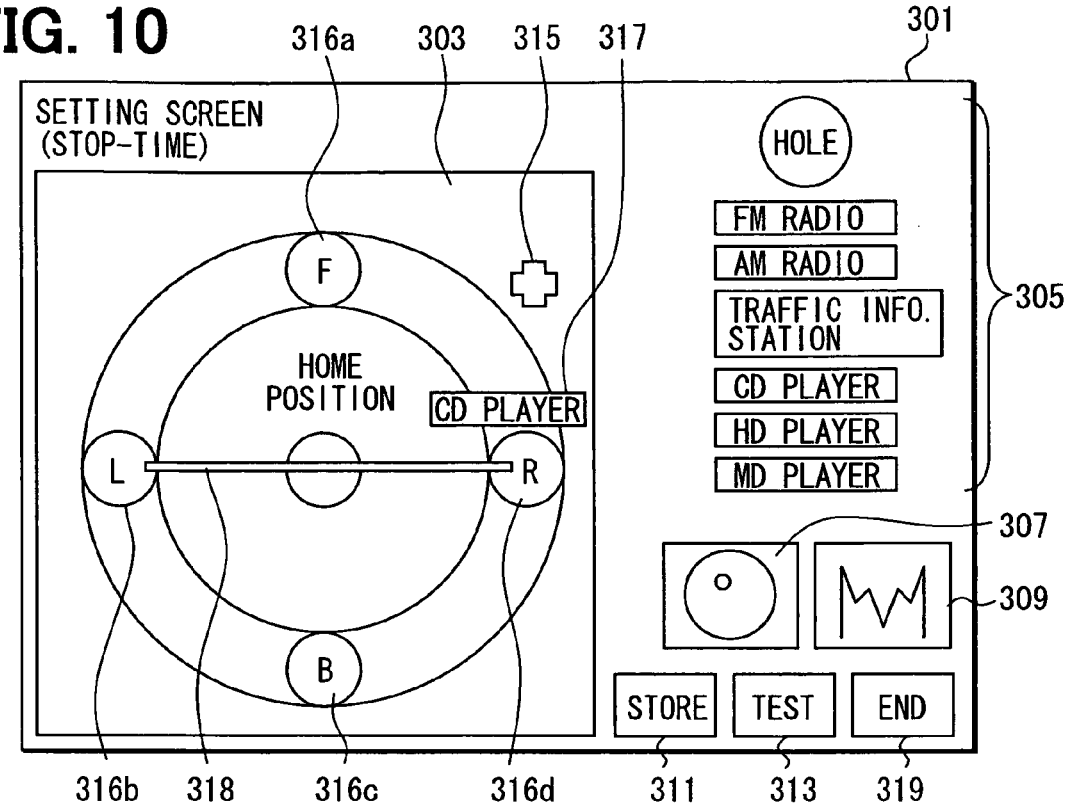
FIG. 10 shows an example of a setting screen displayed on a display unit of the manual operation device.

The hole 316*d* in FIG. 10 is accompanied by a CD player icon 317. In this case, the operation of the operation handle 31 to the position of the hole 316*d* sets the object device under control of the operation handle 31 to a CD player.

The holes 316*a* to 316*d*, the CD player icon 317 or the like can be moved to a desired position by a drag and drop operation controlled by a cursor 315. The force pattern in the force pattern storage unit 63 is immediately changed to reflect the change of the positions of the holes 316*a* to 316*d*, the icon 317 or the like.

The icons 305 includes icons of a hole, an FM radio, an AM radio, a traffic information station, a CD player, an HD player, and an MD player. The icons 305 may be dragged and dropped at anywhere in the operation plane 303 for facilitating the movement of the operation handle 31 thereto. That is, the movement of the operation handle 31 is controlled by positioning the hole in the operation plane 303, and the FM radio or the like positioned in the operation plane 303 sets the object device of the control specified by the movement of the operation handle 31 when the cursor 315 is brought on one of the icons 305. The force pattern in the force pattern storage unit 63 immediately reflects the change caused by the drag and drop operation of each of the icons 407.

The plan view button 307 controls the representation in the operation plane 303 to the plan view. FIG. 10 already shows the plan view, and the plan view button 307 in FIG. 10 is inoperable.

The section view button 309 controls the representation in the operation plane 303 to a cross-sectional view described later in the present embodiment. The section view button 309 becomes operable when a section line 318 is drawn in the operation plane 303 by using the cursor 315.

The store button 311 stores the force pattern in the force pattern storage unit 63 in the memory 15.

The test button 313 conducts a test of the force pattern by using the force pattern stored in the force pattern storage unit 63.

The end button 319 is used to end the force pattern setting mode.

Figure 11:
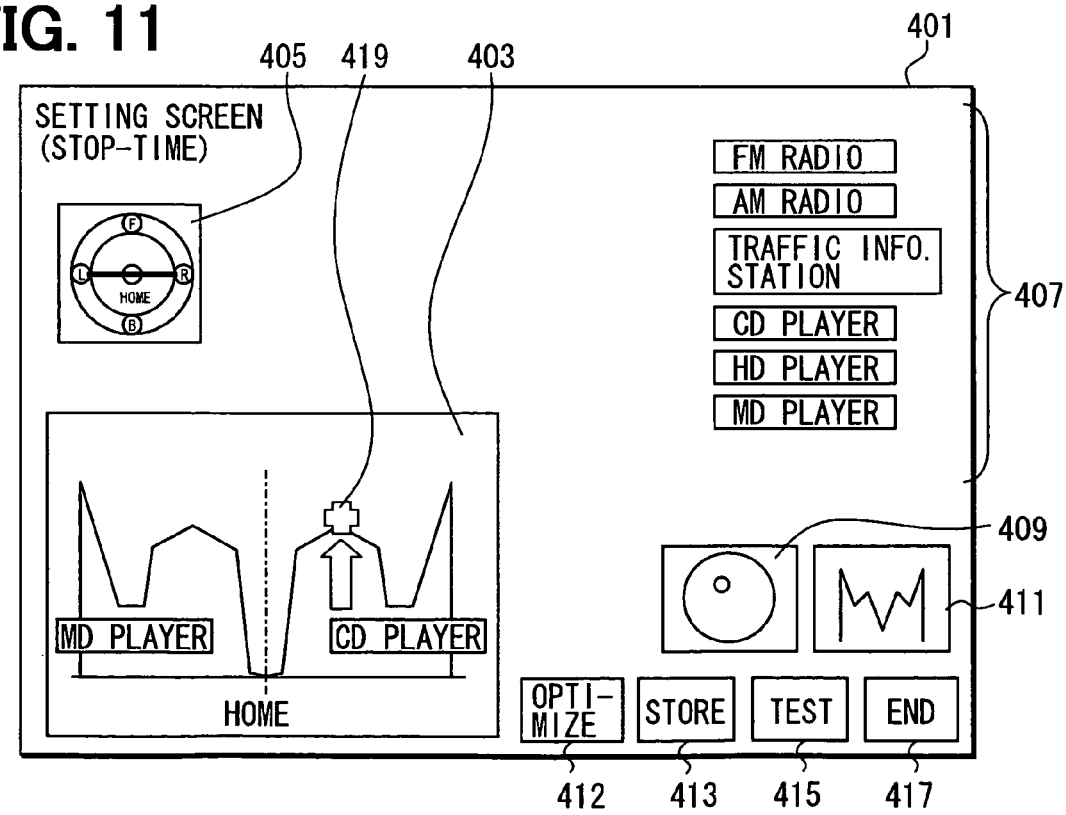
FIG. 11 shows another example of the setting screen displayed on the display unit of the manual operation device.

The section line 318 drawn by the user with the cursor 315 cuts the force pattern in the plan view of the setting screen 301, and, as shown in FIG. 11, the control unit 17 displays a representation of the force pattern in a cross-sectional view 401 on the display unit 22 based on the force pattern in the force pattern storage unit 63 when the section view button 309 is pressed. The cross-sectional view 401 includes an operation plane 403 for representing the force pattern for the operation handle 31 as a cross section by the section line 318, a section line display area 405 for displaying the section line 318 in the plan view, icons 407 to be positioned in the operation plane 403, a plan view button 409 for switching the screen to the plan view 409, a section view button 411 for switching the screen to the section view 411, an optimization button 412 for optimizing the force pattern characteristics, a store button 413 for storing the currently used force pattern in the force pattern storage unit 63 in the memory 15, a test button 415 for testing the force pattern currently stored in the force pattern storage unit 63, and an end button 417 for ending the force pattern setting mode.

The operation plane 403 represents the cross section of the force pattern along the section line 318. The force pattern is applied to the operation handle 31. More practically, a line graph in the operation plane 403 shows a relationship between the operation position of the operation handle 31 on a horizontal axis and the reaction force in response to the movement of the operation handle 31 on a vertical axis.

In FIG. 11, the force pattern represented in the operation plane shows that the hole on the right side of a home position (relative to the looking direction of the driver) has an assignment of a CD player function, and the hole on the left side of the home position (relative to the looking direction of the driver) has an assignment of an MD player function.

The icons of the holes and devices can easily be moved by using a cursor 419 with the drag and drop operation. The line graph in the operation plane 403 can be manipulated by using the cursor 419 to have an arbitrary shape with the drag and drop operation. The force pattern in the force pattern storage unit 63 immediately reflects the change made in the operation plane 403.

The section line display area 405 displays a relationship between a position of the section line 318 and the cross section represented in the operation plane. 403.

The icons 407 includes icons of the hole, the FM radio, the AM radio, the traffic information station, the CD player, the HD player, and the MD player. The icons 407 may be dragged and dropped at anywhere in the operation plane 403 for facilitating the movement of the operation handle 31 thereto. That is, the movement of the operation handle 31 is controlled by positioning the hole in the operation plane 403, and the FM radio or the like positioned in the operation plane 403 sets the object device of the control specified by the movement of the operation handle 31 when the cursor 315 is brought on the icon. The force pattern in the force pattern storage unit 63 immediately reflects the change caused by the drag and drop operation of each of the icons 407.

The plan view button 409 switches the representation in the operation plane 403 to the plan view. The section view button 411 switches the representation in the operation plane 403 to the cross-sectional view. FIG. 11 shows a situation that the section view button 411 is not operable because the cross-sectional view is displayed in the operation plane 403.

The optimization button 412 optimizes the line graph and the force pattern in the force pattern storage unit 63 based on the measurement of the optimum operational reaction force and the restrictive reaction force determined in the operation force measurement process.

The store button 413 stores the currently used force pattern in the force pattern storage unit 63 in the memory 15.

The test button 415 conducts a test of the force pattern by using the force pattern stored in the force pattern storage unit 63.

The end button 417 is used to end the force pattern setting mode.

Figure 12:
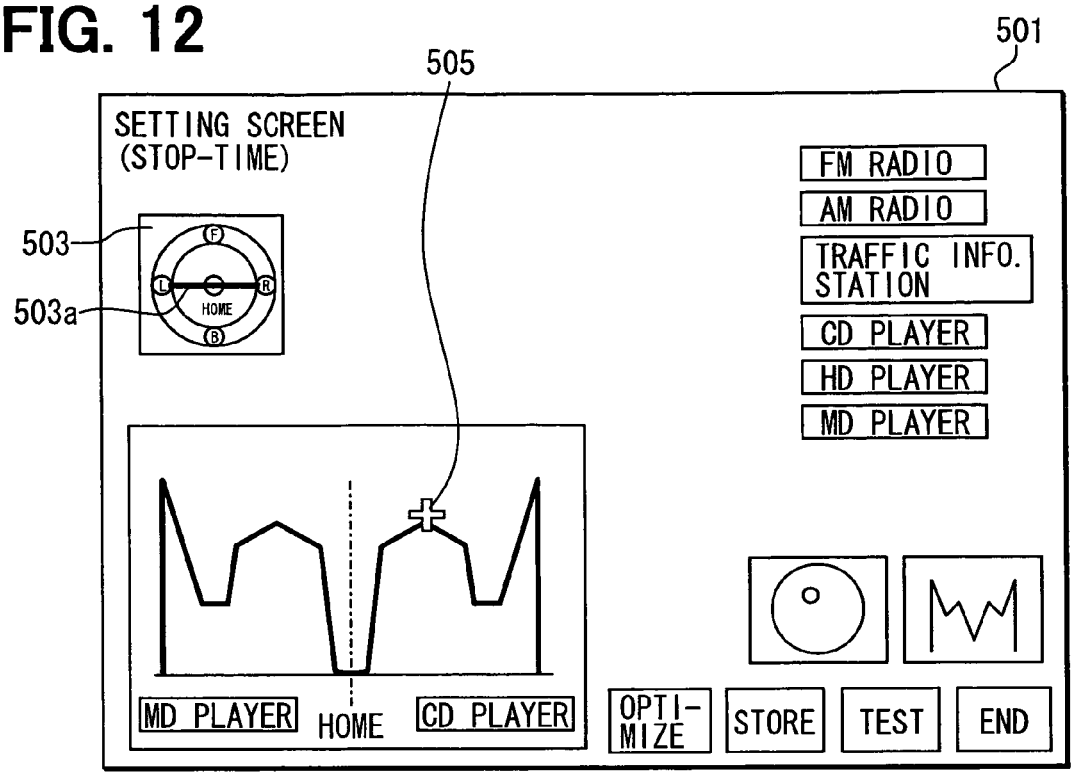
FIG. 12 shows yet another example of the setting screen displayed on the display unit of the manual operation device.

The control unit 17 displays a screen 501 in FIG. 12 on the display unit 22 when the cursor 419 in the screen 401 is brought to and pressed on the test button 415. The screen 501 is similarly arranged as the screen 401 in FIG. 11. Difference between the screen 501 and the screen 401 is as follows.

The movement of the operation handle 31 in the screen 501 in FIG. 12 is restricted along a section line 503*a*, and the operation position of the operation handle 31 is shown by a cursor 505. That is, the user or the driver can recognize the force pattern at the current operation position reflected to the position of the cursor 505 in the screen 501.

Figure 9:
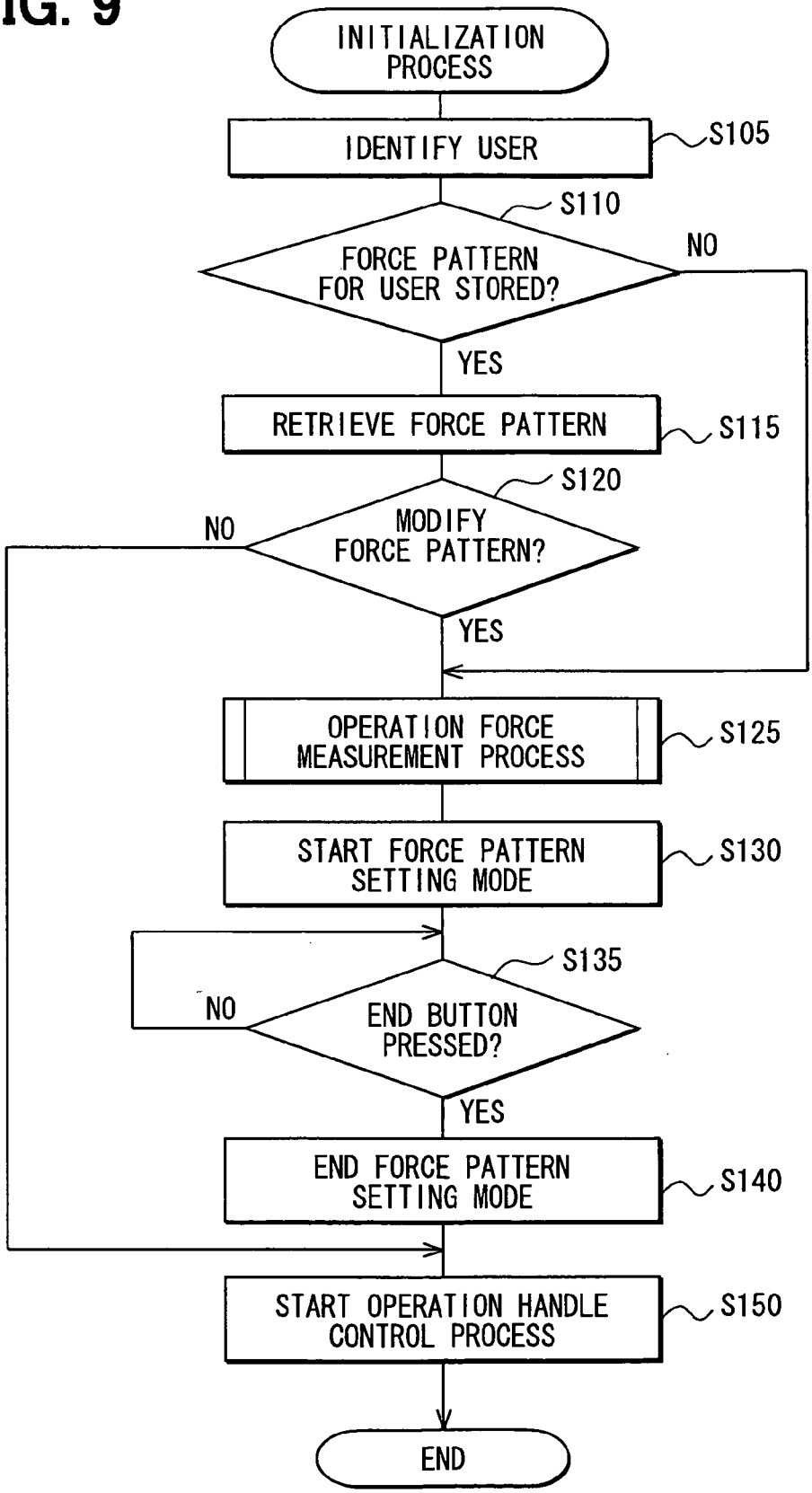
FIG. 9 shows a flowchart of an initialization process in the control unit.

Description returns to an explanation of the initialization process shown as the flowchart in FIG. 9. In step S135, the process determines whether the end button 319 or 417 is pressed. The process proceeds step S140 when the end button 319 or 417 is pressed (step S135:YES). The process repeats step S135 when the end button 319 or 417 is not pressed (step S135:NO).

In step S140, the process terminates the force pattern setting mode. The control unit 17 retains the force pattern specified in the screen 301 or 401 in the force pattern storage unit 63, and erases the screen 301 or 401 from the display unit 22. The process proceeds step S150 after erasing the screen 301 or 401.

In step S150, the control unit 17 starts the operation handle control process by using the force pattern in the force pattern storage unit 63, and concludes the initialization process.

Figure 13:
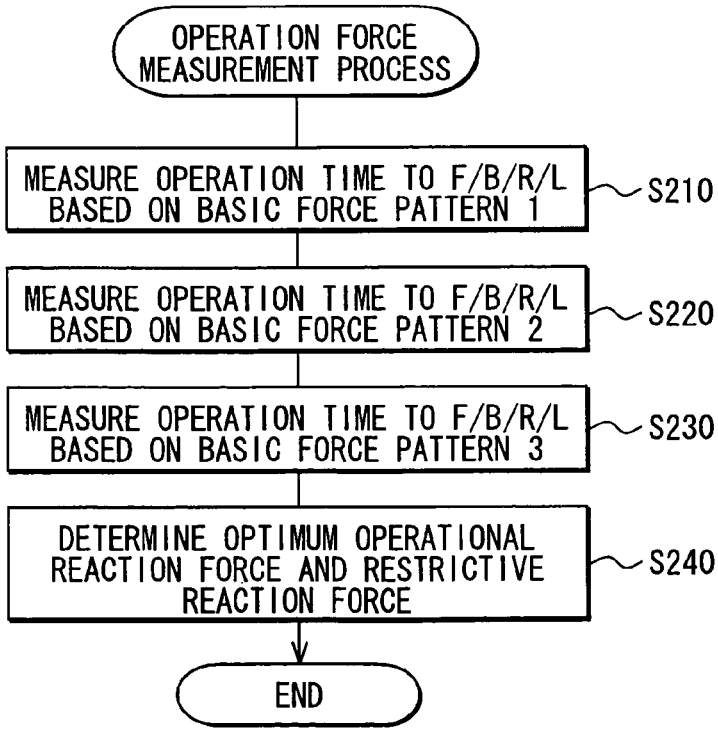
FIG. 13 shows a flowchart of an operation force measurement process in the control unit.

The operation force measurement process controlled by the control unit 17 is described with reference to a flowchart in FIG. 13. The operation force measurement process is called in step S125 in the above description.

Figure 14A:
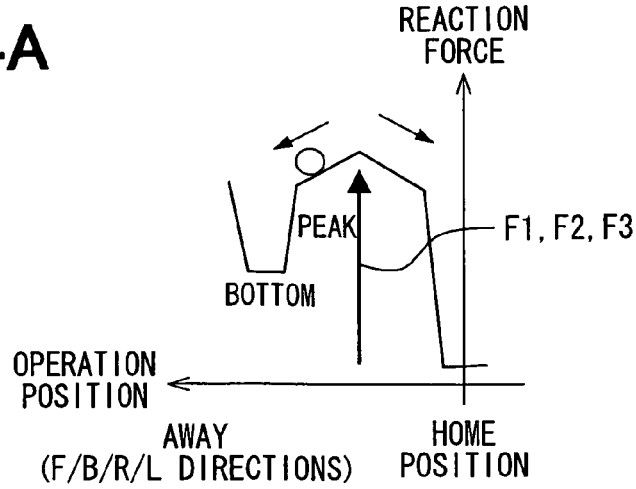
FIG. 14A shows a line graph of a basic force pattern used in the operation force measurement process.

The process of measurement begins with step S210. In step S210, the process measures an operation time in right/left and front/back directions based on a basic force pattern 1. The basic force pattern 1 designates a force pattern depicted by a cross-sectional illustration in FIG. 14A (a partial illustration). The force pattern is characterized by a peak and a bottom when the operation handle 31 is operated away from the home position. That is, the reaction force applied to the operation handle 31 increases toward the peak, and then decreases toward the bottom with a rebound after passing the bottom as the operation handle 31 is moved away from the home position. The basic force pattern 1 applies the reaction force of F1 [N] to the operation handle 31 at the peak. The operation time of the operation handle 31 is a time for the operation of the operation handle 31 from the home position to the bottom in any of the four directions, i.e., the front/back/right/left directions. The process proceeds step S220 after the measurement of the operation time.

In step S220, the process measures the operation time in right/left and front/back directions based on a basic force pattern 2. The basic force pattern 2 applies the reaction force of F2 [N] to the operation handle 31 at the peak. In this case, the reaction force F2 is greater than the reaction force F1. The process proceeds step S230 after the measurement.

In step S230, the operation time is measured based on a basic force pattern 3. The basic force pattern 3 applies the reaction force of F3 [N] to the operation handle 31 at the peak. In this case, the reaction force F3 is greater than the reaction force F2. The process proceeds step S240 after the measurement.

Figure 14B:
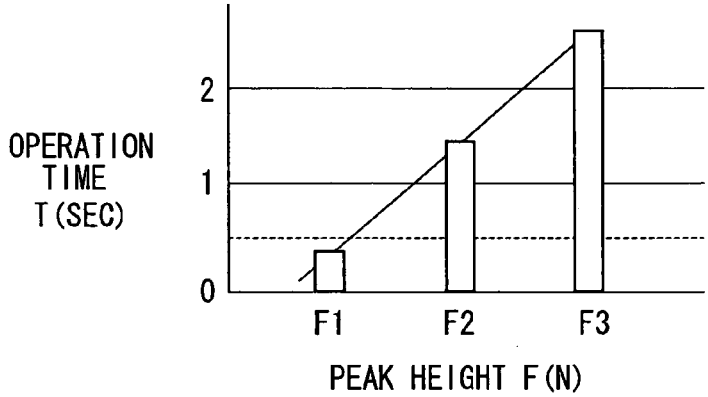
FIG. 14B shows a diagram of relationship between an operation time and basic force patterns.
Figure 14C:
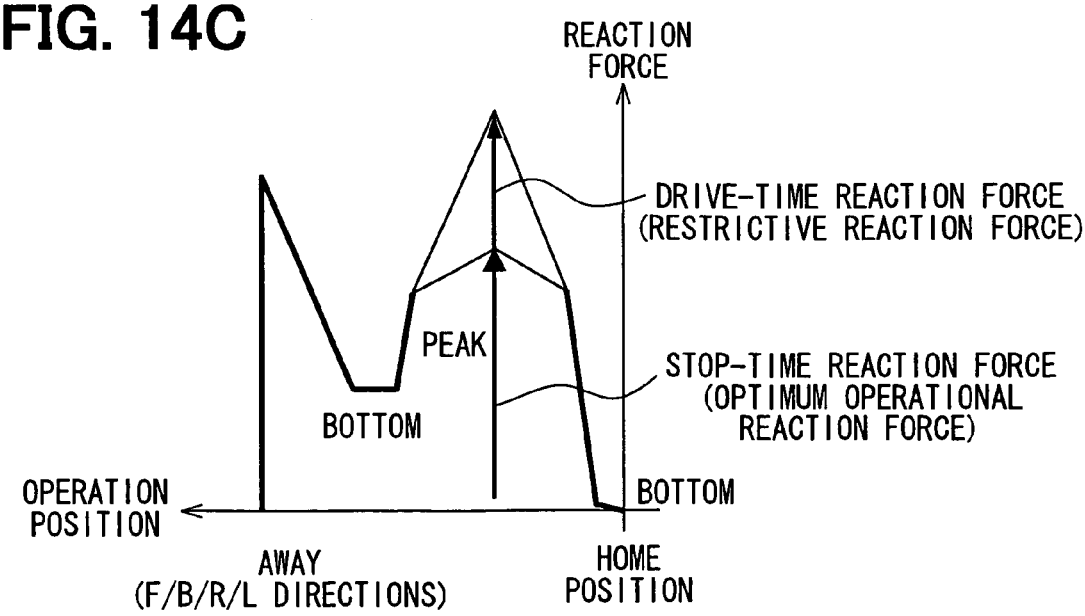
FIG. 14C shows a line graph of an operational reaction force and a restrictive reaction force.

In step S240, the optimum operational reaction force and the restrictive reaction force are determined. The optimum operational reaction force is the reaction force indicated by the height of the peak in FIG. 14A at the stop-time operation of the operation handle 31. For example, the optimum operational reaction force may be determined so as to have the operation time of 0.5 seconds for the process of operation handle 31 operation from the home position to the bottom (FIG. 14B). The restrictive reaction force is applied to the operation handle 31 for restricting the movement of the handle 31. For example, the restrictive reaction force may be determined so as to have the operation time of 2 seconds for the process of operation handle 31 operation over the peak to the bottom (FIG. 14B). The process returns to a calling step after concluding itself when the optimum operational reaction force and the restrictive reaction force are determined (FIG. 14C). In this case, pressing the optimization button 412 in FIG. 11 modifies the height of the peak based on the optimum operational reaction force. When the display unit 22 is showing the force pattern setting screen for drive-time, the restrictive reaction force is used to modify the height of the peak.

The manual operation device 11 in the present disclosure provides for the user or the driver a visual representation of the reaction force on the display unit 22. In this manner, the user or the driver can visually recognize the operation position of the operation handle 31 and the reaction force, thereby allowing the user or the driver to modify the resistive force from the electric motors 39*a*, 39*b* according to the operation force of his/her own. As a result, the reaction force being too weak to cause a miss-operation or the reaction force being too strong to cause a stress is prevented. Further, strength of the reaction force may suitably be adjusted to the user's preference for the ease of operation of the operation handle 31 by the user.

Furthermore, the signal output position for controlling the vehicular devices is visually represented on the display unit 22, thereby allowing the user to make adjustment of the signal output position with ease.

Furthermore, the user or the driver can manually change the line graph on the display unit 22 into the arbitrary shape by the cursor 315 or 419, thereby allowing the user or the driver to have a preferable force pattern that suits his/her manner of operation.

Furthermore, the operation time of the operation handle 31 is taken into consideration for determining the optimum operational reaction force and the restrictive reaction force, thereby enabling reduction of the user operation for making the adjustment of the reaction force. In addition, the reaction force determined in the above-described manner can effectively reduce fault operation of the operation handle 31 because the reaction force suitably reflects an operational force applied to the operation handle 31 by the user.

Although the present disclosure has been fully described in connection with the preferred embodiments thereof with reference to the accompanying drawings, it is to be noted that various changes and modifications will become apparent to those skilled in the art.

For example, although the line graph used in the embodiment described above shows a relationship between the operation position of the operation handle 31 on the horizontal axis and the reaction force applied to the operation handle 31 on the vertical axis (FIGS. 11, 12), the vertical axis may represents a simulated potential energy of the operation handle 31. That is, the operation handle 31 may receive the reaction force or a thrusting force in proportion to the degree of increase or decrease of the potential energy when the movement of the operation position of the operation handle 31 along the horizontal axis causes the increase or decrease of the potential energy represented by the height of the line graph along the vertical axis.

The line graph of the potential energy makes it easier for the user to visually understand the suction force toward the hole icon in the screen. Therefore, the line graph of the potential energy provides improved operability for the user.

Figure 15A:
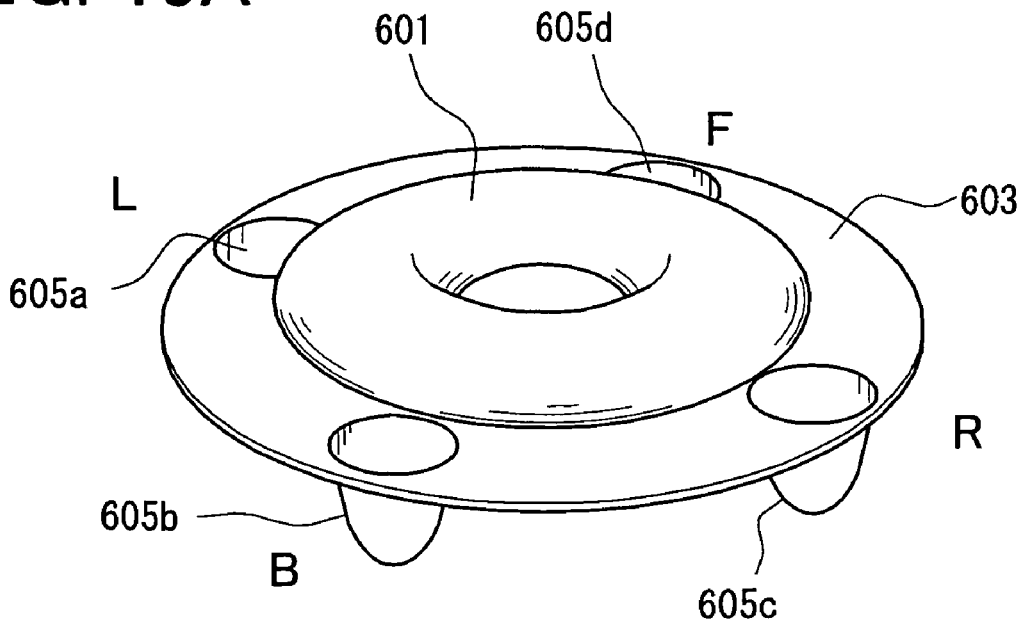
FIG. 15A shows still yet another example of the setting screen displayed on the display unit of the manual operation device.

Further, the line graph in a two dimensional graph space may be replaced by a surface graph in a three dimensional graph space. For example, the surface graph in FIG. 15A may be used to represent the force pattern. In this graph, a ring 601 has a home position at its center, and the operation area of the operation handle 31 extends radially outwardly from the center on a disk portion 603. The height of the ring 601 represents the amount of the reaction force, and four holes 605*a* to 605*d* on the disk portion 603 represent function points for controlling the vehicular devices. The height of the ring 601 may represents the simulated potential energy described above at the operation position of the operation handle 31.

Figure 15B:
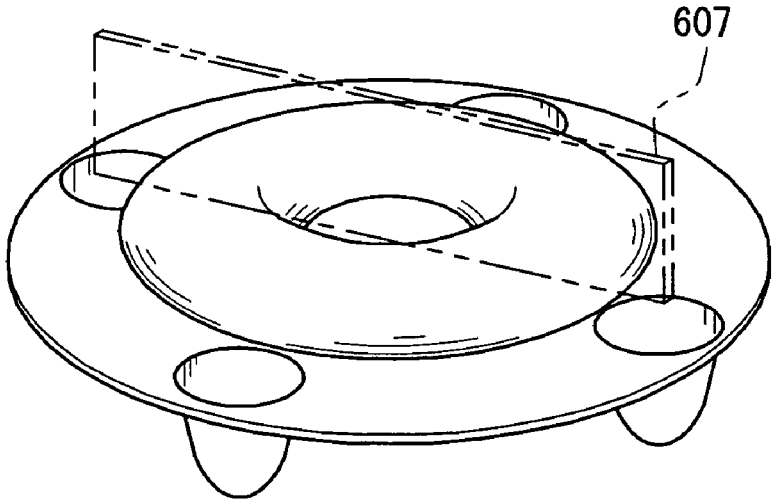
FIG. 15B shows still yet another example of the setting screen displayed on the display unit of the manual operation device.

The adjustment of the force pattern may be made by using a section plane 607 as shown in FIG. 15B. In this manner, the cross-sectional view of the force pattern having the two-dimensional line graph as shown in FIG. 11 is displayed as the setting screen of the force pattern. In addition, the three-dimensional surface graph may directly be manipulated for making the adjustment of the force pattern.

The three-dimensional surface graph can provide for the user an intuitive interface for making adjustment of the force pattern.

Such changes and modifications are to be understood as being within the scope of the present invention as defined by the appended claims.

What is claimed is:

1. A manual operation device in connection to a display unit comprising:

an operation unit for generating an operation signal when movement of the operation unit is caused by a manual operation;

an actuator for applying a driving force to the operation unit;

a position detector for detecting an operation position of the operation unit;

a storage unit for storing a force pattern that simultaneously defines a first relationship between the position of the operation unit and a regulation control value for regulating the driving force of the actuator and a second relationship between the position of the operation unit and a control signal to control an external device; and a control unit for simultaneously outputting the regulation control value to the actuator and the control signal to the external device based on the force pattern stored in the storage unit and the position of the operation unit detected by the position detector, wherein the control unit outputs a three-dimensional graph for representing on the display unit the first relationship between the position of the operation unit and the regulation control value in the force pattern stored in the storage unit, the control unit modifies the first relationship between the position of the operation unit and the regulation control value in the force pattern stored in the storage unit based on one of modification information from an external source and modification information by an operation of the operation unit, the force pattern to be modified is represented by a two-dimensional line graph in a cross-sectional view of the three-dimensional graph cut along an arbitrary line that is drawn by a user in a setting screen, and the operation unit interacts with the user to modify the force pattern by changing a shape of the cross-sectional view through the operation of the operation unit.

2. The manual operation device as in claim 1, wherein the control unit outputs visual representation information for representing on the display unit the second relationship between the operation position of the operation unit and the control signal to control the external device, and the control unit modifies the second relationship between the operation position of the operation unit and the control signal to control the external device unit based on one of the modification information from the external source and the modification information by the operation of the operation unit.

3. The manual operation device as in claim 2, wherein the visual representation information from the control unit represents the two-dimensional line graph in the cross-sectional view defined by a horizontal axis and a vertical axis, the horizontal axis of the line graph defines an amount of the positional change of the operation unit within a boundary of a movable range, the vertical axis of the line graph defines an amount of a reaction force applied to the operation unit at the operation position based on the positional change along the horizontal axis.

4. The manual operation device as in claim 2, wherein the visual representation information from the control unit represents the two-dimensional line graph in the cross-sectional view, a horizontal axis of the line graph defines an amount of positional change of the operation unit within a boundary of a movable range in any direction of positional change at the operation position, a vertical axis of the line graph defines a simulated potential energy in the operation unit at the operation position based on the positional change along the horizontal axis, the simulated potential energy provides for the operation unit an acceleration force or a deceleration force in proportion to an amount of decrease or increase of the simulated potential energy, the acceleration force accelerates or the deceleration force decelerates the operation unit in proportion to the amount of the simulated potential energy lost or gained in the movement of the operation unit defined by the two-dimensional line graph, and acceleration or deceleration of the operation unit is caused by actuator based on the operation signal generated by the operation unit.

5. The manual operation device as in claim 2, wherein the operation unit is operable in at least two axial directions, the visual representation information from the control unit represents a three-dimensional surface graph in a space defined by two horizontal X and Y axes and a vertical Z axis, the three-dimensional surface graph defines a relationship between the operation position of the operation unit and a reaction force applied thereto, the operation position of the operation unit detected by the position detector is mapped on a plane defined by the X and Y axes, and the reaction force applied to the operation unit is determined by a projection of the mapped operation position on the plane defined by the X and Y axes to the three-dimensional surface graph to have reading on the Z axis.

6. The manual operation device as in claim 2, wherein the operation unit is operable in at least two axial directions, the visual representation information from the control unit represents a three-dimensional surface graph in a space defined by two horizontal X and Y axes and a vertical Z axis, the three-dimensional surface graph defines a relationship between the operation position of the operation unit and a simulated potential energy of the operation unit, the operation position of the operation unit detected by the position detector is mapped on a plane defined by the X and Y axes, the simulated potential energy of the operation unit is determined by a projection of the mapped operation position on the plane defined by the X and Y axes to the three-dimensional surface graph to have reading on the Z axis, the simulated potential energy provides for the operation unit an acceleration force in proportion to an amount of decrease of the simulated potential energy when the movement of the operation unit decreases the simulated potential energy, and the simulated potential energy provides for the operation unit a deceleration force in proportion to an amount of increase of the simulated potential energy when the movement of the operation unit increases the simulated potential energy.

7. The manual operation device as in claim 3, wherein the modification information to the control unit includes the modification information on a shape of the graph, and the control unit modifies the relationship between the position of the operation unit and the regulation control value in the force pattern stored in the storage unit based on the modification information on the shape of the graph.

8. The manual operation device as in claim 1 further comprising:

an operation force detection unit for detecting an operation force applied to the operation unit, wherein the control unit modifies the relationship between the operation position of the operation unit and the regulation control value in the force pattern based on the operation force detected by the operation force detection unit.

9. The manual operation device as in claim 8, wherein the control unit determines a maximum regulation control value outputted to the actuator based on the operation force detected by the operation force detection unit while the operation unit is moved away from a home position to a functional position that outputs the control signal for controlling the external device, and the control unit modifies the relationship between the position of the operation unit and the regulation control value in the force pattern based on the maximum regulation control value determined by the control unit.

* * * * *